US006695305B2

(12) United States Patent
Müller et al.

(10) Patent No.: US 6,695,305 B2
(45) Date of Patent: Feb. 24, 2004

(54) METHOD OF CONTROLLING OR REGULATING THE VERTICAL POSITION OF PILED OR STACKED SHEETS

(75) Inventors: Tobias Müller, Hirschberg (DE); Thomas Wolf, Karlsruhe (DE); Jürgen Zeltner, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 183 days.

(21) Appl. No.: 09/748,478

(22) Filed: Dec. 26, 2000

(65) Prior Publication Data

US 2001/0006271 A1 Jul. 5, 2001

(30) Foreign Application Priority Data

Dec. 23, 1999 (DE) ..... 199 62 524

(51) Int. Cl.[7] ..... B65H 1/18
(52) U.S. Cl. ..... 271/152; 414/926
(58) Field of Search ..... 271/148, 152, 271/3, 13; 414/626, 926

(56) References Cited

U.S. PATENT DOCUMENTS 3,716,226 A * 2/1973 Kistner
5,244,340 A * 9/1993 Pizzi et al. ..... 414/296

FOREIGN PATENT DOCUMENTS

| | | | |
|---|---|---|---|
| DE | 1146507 | * | 4/1963 |
| DE | 16 11 363 | | 11/1971 |
| DE | 1 786 008 | | 11/1971 |
| DE | 196 20 937 A1 | | 11/1997 |

* cited by examiner

*Primary Examiner*—Janice L. Krizek
(74) *Attorney, Agent, or Firm*—Laurence A. Greenberg; Werner H. Stemer; Ralph E. Locher

(57) ABSTRACT

A method of controlling or regulating the vertical position of piled or stacked sheets, which includes determining at the leading edge and at the trailing edge, respectively, of the sheet resting on the top of the sheet pile, the vertical position of the sheet: and, depending upon the vertical position of the leading edge and the trailing edge, respectively, moving in the vertical direction at least one lifting element associated with the sheet trailing edge. The method further comprises, displacing the sheet pile and the lifting element, respectively, a given distance in the vertical direction, when a large discrepancy is found between the vertical position at the leading edge and a nominal value.

8 Claims, 3 Drawing Sheets

METHOD OF CONTROLLING OR REGULATING THE VERTICAL POSITION OF PILED OR STACKED SHEETS

BACKGROUND OF THE INVENTION

Field of the Invention

The invention relates to a method of controlling or regulating the vertical position of piled or stacked sheets, more particularly, in a feeder of a sheet-processing machine, which includes determining the vertical position of the sheet resting on the top of the sheet pile, at the leading edge thereof and at the trailing edge thereof and, depending upon the vertical position of the leading edge and the trailing edge, respectively, moving at least one lifting element associated with the sheet trailing edge in the vertical direction.

The published German Patent Application DE 196 20 937 A1 reveals a method of the type mentioned hereinbefore, wherein the pile height, i.e., the vertical position of the sheet resting on the top of the sheet pile, is determined with the aid of sensors, a first sensor being associated with the pile leading edge, and determining thereat the information as to the height of the pile leading edge relative to a forwarding flap or an infeed roller on a feeder table, and a second sensor being applied to a lifting element associated with the pile trailing edge and furnishing information about the vertical position of the pile trailing edge relative to the lifting element, which is vertically adjustable by a motor. Because it is difficult to register the pile top edge at the leading edge, in particular, in the case of overlapping or imbricated feeders, because of the sheet delivery sequence and the great entrainment of air, wide variability of the measurement results often occurs. The direct use of the signal for controlling the lifting of the pile, and the subsequent control of the height of the lifting element based upon the information determined by the second sensor therefore leads to a poor, unstable control loop, wherein the correct vertical position of the sheets arranged under the lifting element can very often barely be assured. The pile height determined at the leading edge is often also too inaccurate if the pile height at the leading edge changes considerably and abruptly, as happens, for example, in the course of non-stop operation during the withdrawal of pile rakes and bars, respectively, arranged between the piled or stacked sheets.

SUMMARY OF THE INVENTION

It is accordingly an object of the invention to provide a method of controlling or regulating the vertical position of piled or stacked sheets, which does not have these drawbacks or disadvantages.

With the foregoing and other objects in view, there is provided, in accordance with the invention, a method of controlling or regulating the vertical position of piled or stacked sheets, including determining at the leading edge and at the trailing edge, respectively, of the sheet resting on the top of the sheet pile, the vertical position of the sheet and, depending upon the vertical position of the leading edge and the trailing edge, respectively, moving in the vertical direction at least one lifting element associated with the sheet trailing edge, which comprises, displacing the sheet pile and the lifting element, respectively, a given distance in the vertical direction, when a large discrepancy is found between the vertical position at the leading edge and a nominal value.

In accordance with another mode, the method invention includes, when a small discrepancy is found between the vertical position at the leading edge and the nominal value, displacing only the lifting element in the vertical direction.

In accordance with a further mode of the method invention, the displacement of the lifting element in the vertical direction is relatively slow.

In accordance with an added mode, the method invention includes, when a large discrepancy is found between the vertical position at the trailing edge and the nominal value, displacing only the lifting element a given distance in the vertical direction.

In accordance with an additional mode of the method invention, the displacement of the lifting element is relatively quick.

In accordance with yet another mode, the method invention includes, when a small discrepancy is found between the vertical position at the trailing edge and the nominal value, displacing only the sheet pile a given distance in the vertical direction.

In accordance with yet a further mode, the method invention includes, when a small discrepancy is found between the vertical position at the trailing edge and the nominal value, displacing only the sheet pile continuously in the vertical direction.

In accordance with yet an added mode of the method invention, the nominal value of the vertical position at the trailing edge has a range of tolerance which is narrower than the range of tolerance of the nominal value of the vertical position at the leading edge.

In accordance with a concomitant mode, the method invention includes performing the steps thereof in a feeder of a sheet-processing machine.

In order to achieve the stated object of the invention, a method is proposed which can be used to control or regulate the vertical position of piled sheets in the feeder of a sheet-processing machine, such as a sheet-fed rotary printing machine, for example, the vertical position of the sheet resting on the top of the sheet pile is determined at the leading edge and at the trailing edge thereof. Depending upon the leading-edge vertical position and the trailing-edge vertical position, the sheet pile and at least one lifting element, respectively, associated with the sheet trailing edge is displaced accordingly in the vertical direction. The method is distinguished by the fact that in the event of a large discrepancy between the vertical position at the leading edge and a nominal or desired value, the sheet pile and the lifting element are displaced simultaneously or virtually simultaneously, respectively, a given or specific distance, in the vertical direction. As a result of the synchronous or virtually synchronous displacement of the sheet pile and of the lifting element, in particular large vertical discrepancies at the pile leading edge can be compensated for quickly, it being possible at the same time to prevent excessively large vertical discrepancies from the nominal value occurring from time to time at the trailing edge. Very narrow tolerances are preferably maintained or complied with at the sheet/pile trailing edge, in order to be able to assure reliable sheet separation.

In an advantageous embodiment of the method, in the event of a small discrepancy between the vertical position at the leading edge and the nominal or desired value, only the lifting element is displaced in the vertical direction. This is preferably performed only at a low speed. The displacement of the lifting element is preferably performed continuously until the nominal or desired value is reached again, or else cyclically, i.e., the lifting element is respectively moved vertically a given or specific distance. The vertical edge of the pile leading edge is therefore evaluated merely as a trend which is used for moving the lifting element vertically over a relatively great time, and therefore slowly, in such a way that the pile leading edge remains within the range of tolerance thereof.

In a preferred embodiment of the method, in the event of a large discrepancy between the vertical position at the trailing edge and a nominal or desired value, only the lifting element is displaced a given or specific amount in the vertical direction. This is preferably performed relatively quickly, i.e., at an appropriately high speed. Because of the low mass of the lifting element, it is therefore possible to react very quickly to a change in the vertical position of the trailing edge, and the lifting element can be tracked appropriately, so that in this case precise sheet separation can be assured.

Other features which are considered as characteristic for the invention are set forth in the appended claims.

Although the invention is illustrated and described herein as a method of controlling or regulating the vertical position of piled or stacked sheets, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
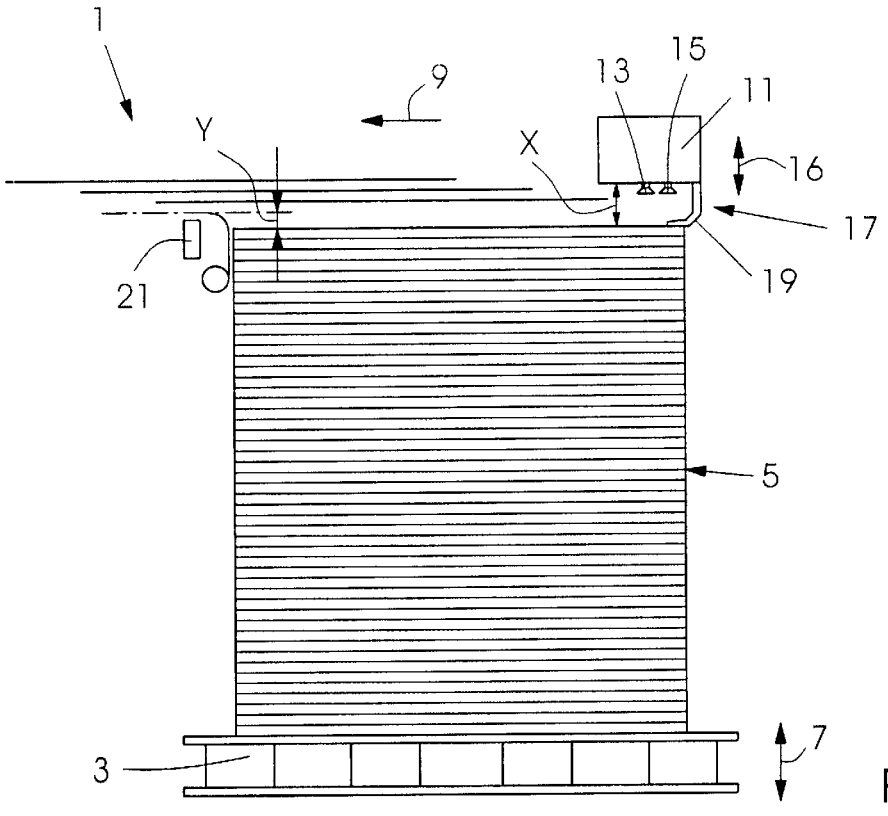
FIG. 1 is a diagrammatic side elevational view of an exemplary embodiment of a feeder of a sheet-processing machine.

Referring now to the drawings and, first, particularly to FIG. 1 thereof, there are shown therein details of an exemplary embodiment of a feeder 1 of an otherwise non-illustrated sheet-processing machine. Arranged in the feeder 1 is a pile pallet 3, whereon sheets are piled to form a sheet pile 5. The pile pallet 3 is displaceable in the vertical direction, i.e., upwardly and downwardly, together with the sheet pile 5, as indicated by the double-headed arrow 7. As viewed in the direction of transport 9 of the sheets to be separated, above the sheet pile 5, and in the vicinity of the trailing edge thereof, a lifting device 11 is provided, by the aid of which the respective sheet lying on the top of the sheet pile 5 is removable from the sheet pile 5. In this exemplary embodiment, a lifting device 11 includes two lifting elements 13 and 15, respectively, having a sucker to which vacuum is applicable, and being displaceable in the vertical direction represented by the double-headed arrow 16. In order to separate a sheet, the lifting elements 13 and 15 are lowered onto the sheet pile 5, so that the top sheet can be gripped and, during an upward movement of the lifting elements 13 and 15, lifted off the sheet pile 5 in the rear or trailing-edge region thereof. The lifting device 11 also has at least one sensor 17, which is constructed in this embodiment as a key or contact-foot sensor 19. Through the intermediary of the sensor 17, the vertical position or height of the top sheet on the sheet pile 5 can be determined, i.e., the vertical position of the pile rear or trailing edge relative to the vertically adjustable lifting device 11.

Provided in the vicinity of the leading edge of the sheet pile 5 is a further sensor 21, by the aid of which the height or vertical position of the sheet pile 5 can be determined.

Figure 2:
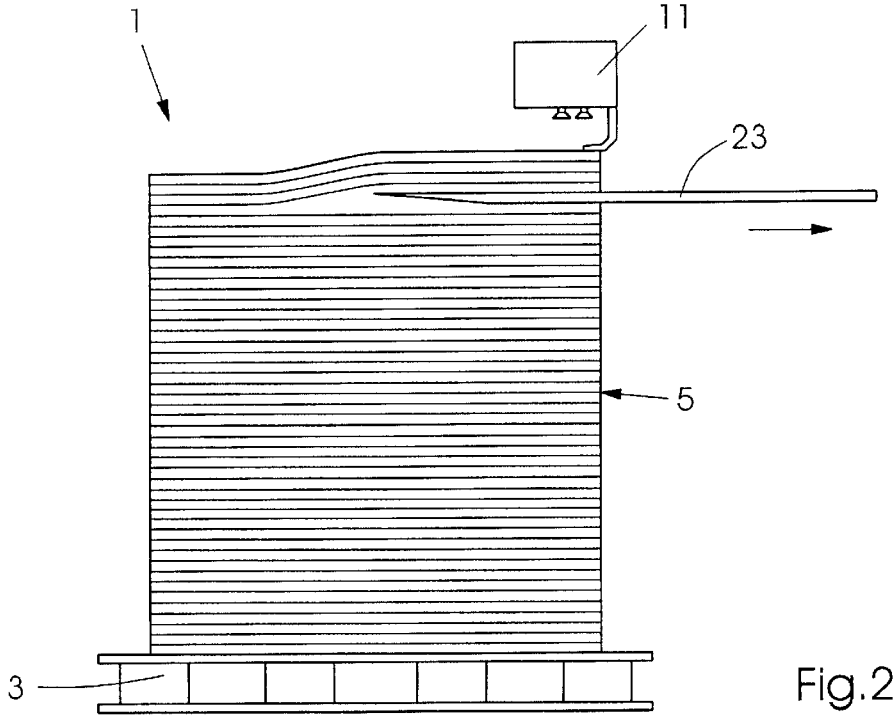
FIG. 2 is a view like that of FIG. 1 of the feeder in a different operating phase thereof wherein a pile rake is partly withdrawn from a sheet pile of the feeder.

As is apparent from FIG. 1, the separation or singling of the sheets is controlled so that the sheets are removed overlapped or imbricated, and/or are transported onward in overlapped or imbricated position, i.e., while the trailing edge of a sheet that has already been lifted off the sheet pile 5 remains located above the sheet pile 5, at least one further sheet has already been lifted off the sheet pile 5 and carried onward in the transport direction 9. FIG. 2 shows details of the feeder 1 illustrated in FIG. 1, wherein, in the vicinity of the trailing edge of the sheet pile 5, a pile rake 23 is being withdrawn from the sheet pile 5. This operating phase or condition occurs when piles are being combined during a non-stop operation at the feeder. It becomes clear that, during the withdrawal of the pile rake 23, the vertical position of the pile leading edge and the vertical position of the pile trailing edge differ considerably from one another. It should further be noted that the sensor 21 associated with the leading edge of the sheet pile 5 is not shown in FIG. 2.

Figure 3:
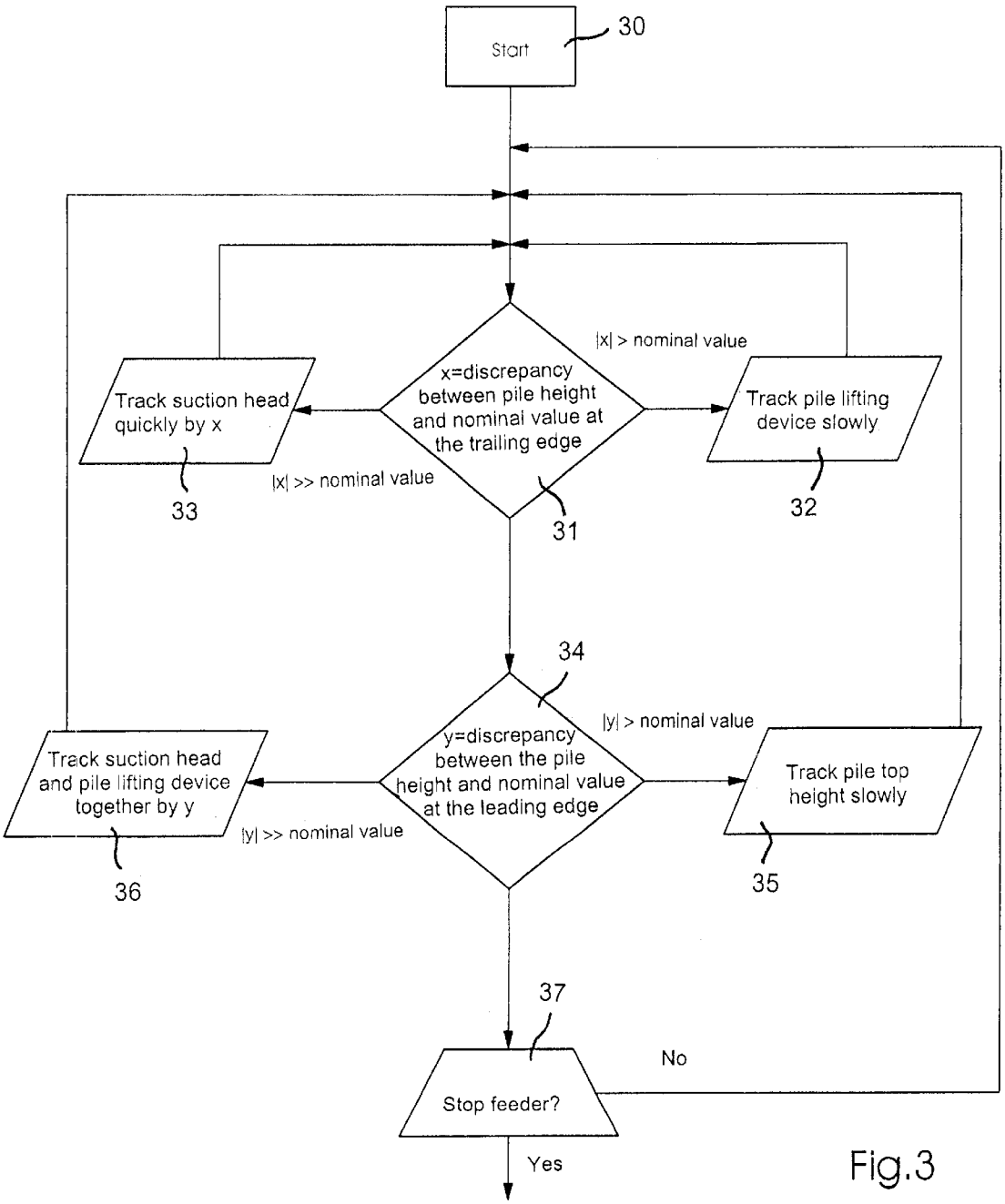
FIG. 3 is a flow diagram of the method according to the invention, wherein pile height sensors are used at the leading and trailing edge, respectively, of the sheet pile.

Hereinafter, the control logic of the feeder illustrated in FIG. 1 is explained in detail with reference to the flow chart of FIG. 3.

After starting at 30, through the intermediary of the sensor 17 associated with the trailing edge of the sheet pile 5, a discrepancy X between the vertical position of the sheet pile trailing edge and a desired or nominal value is determined at 31. If the amount of the discrepancy X is greater than the nominal value, the pile pallet 3, together with the sheet pile 5 located thereon, is tracked slowly at 32, i.e., is moved upwardly a specific distance vertically in the direction of the lifting device 11, which will be referred to hereinbelow as the suction head, so that a desired or nominal spacing between the top sheet on the sheet pile 5 and the suction head is provided. If the amount of the pile height discrepancy X from the nominal value at the trailing edge should be considerably greater than the nominal value, the suction head is tracked rapidly by the amount of the discrepancy at 33. The second sensor 21 is used to determine at 34 how large the discrepancy Y of the vertical position at the leading edge is from a desired or nominal value. If the magnitude of the discrepancy Y is greater than the desired or nominal value, the suction head is tracked slowly at 35, specifically to such an extent that the discrepancy Y is within the tolerance limit. If the amount of the discrepancy Y of the pile height from the desired or nominal value at the leading edge should be considerably greater than the predefined desired or nominal value, for example, during the withdrawal of the non-stop bars or of the pile rake, the suction head and the sheet pile are tracked together, i.e., simultaneously, at 36 by the amount of the discrepancy Y. The tracking of the suction head and of the sheet pile is performed here until the discrepancy Y of the pile height from the desired or nominal value at the leading edge of the sheet pile 5 is within the required tolerance limits. Vertical tracking is then stopped at 37.

Figure 4:
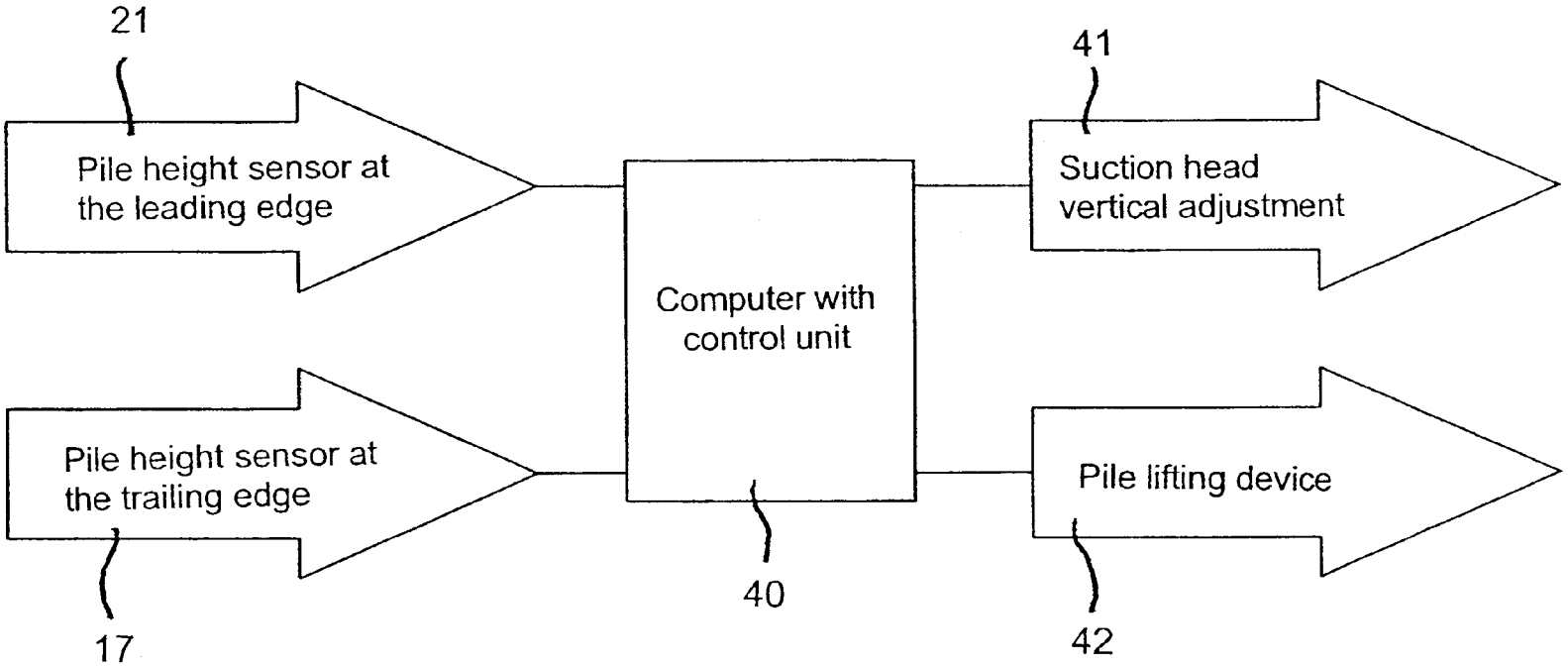
FIG. 4 is a block diagram illustrating the configuration of sensors and actuators for controlling the sheet pile.

FIG. 4 is a block diagram pictorially illustrating the configuration of sensors and actuators for controlling or regulating the sheet pile 5 within the feeder 1. It is believed to be apparent that the information from the sensors 17 and 21 relating to the vertical position of the sheet pile trailing edge and the sheet pile leading edge, respectively, is processed by a computer equipped with a control unit 40 and that, depending upon the leading edge vertical position and the trailing edge vertical position, the sheet pile 5 and the suction head are displaced appropriately in the vertical direction 41 and 42.

We claim:

1. A method of controlling a vertical position of piled sheets in a feeder of a sheet-processing machine, which comprises:

determining at a leading edge of a sheet resting on a top of the sheet pile, the vertical position of the sheet with a single sensor;

depending upon the vertical position of the leading edge, moving in a vertical direction the sheet pile and at least one lifting element associated with a sheet trailing edge, respectively; and displacing the sheet pile and the lifting element substantially at the same time a given distance in the vertical direction upon a large discrepancy between the vertical position at the leading edge and a desired value of the vertical position at the leading edge.

2. The method according to claim 1, which includes:

determining at the trailing edge of the sheet the vertical position of the sheet with a single sensor; and upon a small discrepancy between the vertical position at the trailing edge and a desired value of the vertical position at the trailing edge, displacing only the sheet pile a given distance in the vertical direction.

3. The method according to claim 1, which includes:

determining at the trailing edge of the sheet the vertical position of the sheet with a single sensor; and upon a small discrepancy between the vertical position at the trailing edge and a desired value of the vertical position at the trailing edge, displacing only the sheet pile continuously in the vertical direction.

4. The method according to claim 1, which includes upon a small discrepancy between the vertical position at the leading edge and the desired value, displacing only the lifting element in the vertical direction.

5. The method according to claim 4, wherein the displacement of the lifting element in the vertical direction is relatively slow with respect to a processing speed of the sheet pile.

6. The method according to claim 1, which includes:

determining at the trailing edge of the sheet the vertical position of the sheet with a single sensor; and upon a large discrepancy between the vertical position at the trailing edge and a desired value of the vertical position at the trailing edge, displacing only the lifting element a given distance in the vertical direction.

7. The method according to claim 6, wherein the displacement of the lifting element is relatively quick with respect to a processing speed of the sheet pile.

8. The method according to claim 6, wherein the desired value of the vertical position at the trailing edge has a range of tolerance narrower than the range of tolerance of the desired value of the vertical position at the leading edge.

* * * * *